US010938085B2

(12) United States Patent
Maruyama et al.

(10) Patent No.: US 10,938,085 B2
(45) Date of Patent: Mar. 2, 2021

(54) ANTENNA STRUCTURE

(71) Applicant: NIHON DENGYO KOSAKU CO., LTD., Tokyo (JP)

(72) Inventors: Akira Maruyama, Tokyo (JP); Hiroki Hagiwara, Tokyo (JP); Yukio Sato, Tokyo (JP)

(73) Assignee: NIHON DENGYO KOSAKU CO., LTD., Tokyo (JP)

( * ) Notice: Subject to any disclaimer, the term of this patent is extended or adjusted under 35 U.S.C. 154(b) by 57 days.

(21) Appl. No.: 16/483,753

(22) PCT Filed: Feb. 6, 2017

(86) PCT No.: PCT/JP2017/004274
§ 371 (c)(1),
(2) Date: Aug. 6, 2019

(87) PCT Pub. No.: WO2018/142626
PCT Pub. Date: Aug. 9, 2018

(65) Prior Publication Data

US 2020/0194868 A1 Jun. 18, 2020

(51) Int. Cl.
*H01Q 1/12* (2006.01)

(52) U.S. Cl.
CPC ..... *H01Q 1/12* (2013.01)

(58) Field of Classification Search
CPC ..... H01Q 1/12; H01Q 1/1221; H01Q 1/44; H01Q 1/50; H01Q 1/526; H01Q 15/14
See application file for complete search history.

(56) References Cited

U.S. PATENT DOCUMENTS 2,237,426 A * 4/1941 Grassnick ..... H01Q 1/50 307/328
2015/0194722 A1 7/2015 Chinn
2016/0172765 A1 6/2016 Motta-Cruz et al.
2019/0112806 A1* 4/2019 Hagiwara ..... H01Q 1/1221

FOREIGN PATENT DOCUMENTS

| | | |
|---|---|---|
| CN | 102039352 | 5/2011 |
| CN | 104218379 | 12/2014 |
| JP | 2001284929 | 10/2001 |
| JP | 2016111562 | 6/2016 |
| JP | 2016525849 | 8/2016 |
| JP | 2017183850 | 10/2017 |

OTHER PUBLICATIONS

"International Search Report (Form PCT/ISA/210)" of PCT/JP2017/004274, dated Apr. 25, 2017, with English translation thereof, pp. 1-2.

* cited by examiner

*Primary Examiner* — Thai Pham
(74) *Attorney, Agent, or Firm* — JCIPRNET

(57) ABSTRACT

An antenna structure to which the present invention is applied includes: a film that transmits visible light and has antennas formed thereon; a feeding part to which coaxial cables for feeding power to the antennas are connected; a flange that transmits visible light and is used for positioning the film from a visible side of equipment; and positioning structures for positioning the film from an invisible side of the equipment.

13 Claims, 6 Drawing Sheets

ANTENNA STRUCTURE

CROSS-REFERENCE TO RELATED APPLICATION

This application is a 371 application of the international PCT application serial no. PCT/JP2017/004274, filed on Feb. 6, 2017. The entirety of the abovementioned patent application is hereby incorporated by reference herein and made a part of this specification.

TECHNICAL FIELD

The present invention relates to an antenna structure attached to an equipment.

BACKGROUND ART

In Patent Literature 1, regarding an optically transparent panel antenna assembly including an optically transparent antenna having an array of radiating elements that transmit or receive RF signals, to be integrated into a glass surface with ease, the assembly includes an optically transparent reflector, the reflector including a lower wall and two lateral walls, each lateral wall extending from the lower wall so that the array of radiating elements is maintained between both lateral walls of the reflector.

CITATION LIST

Patent Literature

Patent Literature 1: Publication number of Japanese translations of PCT International Application: JP 2016-525849A

SUMMARY

Technical Problem

In general, a visible light transmissive antenna is designed to produce an antenna including a transparent antenna surface to blend in with the environment. However, an antenna structure includes, for example, a connecting part between the antenna and a feeding board, a connecting part between the antenna and a cable, and so forth. Therefore, even when, for example, a feeder cover portion or the like was used in order to hide such connecting parts, since elements of the connecting parts were, for example, opaque, there were limitations in having good appearance of the antenna structure and the equipment including the feeder cover portion and so forth.

An object of the present invention is to provide an antenna structure having better visual appearance from a visible side of equipment when being attached to the equipment, as compared to a case in which the present technique is not adopted.

Solution to Problem

A first aspect embodiment of the invention provides an antenna structure including: a base material on which an antenna is formed, the base material transmitting visible light; a feeding part to which a feeding member for feeding power to the antenna is connected; a flange that positions the base material from a visible side of an equipment, and transmits visible light; and a positioning structure for performing positioning from an invisible side of the equipment, to which an operation of attaching the base material is performed.

A second aspect embodiment of the invention is the antenna structure according to the first aspect, wherein, when the base material is attached to the equipment, the feeding part is provided at a position facing toward the invisible side of the equipment with respect to the base material.

A third aspect embodiment of the invention is the antenna structure according to the second aspect, wherein the feeding part is formed integrally with the flange at a position opposite to an attachment side of the base material from the flange.

A fourth aspect embodiment of the invention is the antenna structure according to the first aspect, wherein the flange includes a wide structure having a width wider than that of the feeding part, and holds the base material to fix thereof.

A fifth aspect embodiment of the invention is the antenna structure according to the fourth aspect, wherein the flange includes the plural wide structures corresponding to the number of the feeding parts, and also includes a coupling part that couples the plural wide structures.

A sixth aspect embodiment of the invention is the antenna structure according to the first aspect, wherein the flange has a dividing structure divided into a direction crossing to a direction in which the base material extends, and the positioning structure includes a screw part that is divided into a direction crossing to a dividing direction of the dividing structure of the flange and a fastening part that is screwed over the screw part to fasten the flange to the equipment.

A seventh aspect embodiment of the invention is the antenna structure according to the first aspect, wherein the positioning structure is formed by a member that transmits less visible light than the flange.

A eighth aspect embodiment of the invention is the antenna structure according to the first aspect, wherein the positioning structure includes: a screw part that is assembled to the feeding part and covers a circuit board extending from the feeding part; and a fastening part that positions the base material to the equipment by fastening the screw part by screwing from the invisible side of the equipment.

A ninth aspect embodiment of the invention is the antenna structure according to the eighth aspect, wherein the screw part of the positioning structure includes a region with no thread.

A tenth aspect embodiment of the invention is the antenna structure according to the ninth aspect, wherein the positioning structure is divided into plural in the region, and each dividing surface includes a concave part and a convex part, the concave part and the concave part being fitted together when the positioning structure is assembled to the feeding part.

A eleventh aspect embodiment of the invention is the antenna structure according to the first aspect, wherein the antenna structure is fixed to the equipment by a nut including a female screw having a first diameter and a pouch-shaped part having a second diameter larger than the first diameter.

A twelfth aspect embodiment of the invention provides an antenna structure including: a base material on which plural antennas are formed, the base material being formed by a film material or a plate material transmitting visible light; plural feeding parts, to each of which a feeding member extending from each of the plural antennas for feeding power to each of the antennas is connected; and a flange that transmits visible light, the flange holding the base material and coupling the plural feeding parts, wherein the base material and the flange transmitting the visible light are exposed portions that are seen from a user, and the plural feeding parts are not included in the exposed portions.

A thirteenth aspect embodiment of the invention is the antenna structure according to the twelfth aspect, further including: a positioning structure provided for each of the plural feeding parts and positioning the base material to an equipment, wherein the positioning structure is formed by a member that transmits less visible light than the flange.

Advantageous Effects of Invention

According to the first aspect embodiment of the invention, when the antenna structure is attached to the equipment, it is possible to provide better visual appearance from the visible side of the equipment, as compared to a case in which the present technique is not adopted.

According to the second aspect embodiment of the invention, the feeding part can be hardly seen from the visible side, to thereby provide good appearance.

According to the third aspect embodiment of the invention, integrity of the flange positioned in the visible side and the feeding part extending in the invisible side can be obtained.

According to the fourth aspect embodiment of the invention, a fixing function by the flange provided to the visible side is made better, as compared to a case in which the present technique is not adopted.

According to the fifth aspect embodiment of the invention, by the structure including plural antennas, it is possible to provide better visual appearance from the visible side of the equipment.

According to the sixth aspect embodiment of the invention, it is possible to reduce costs, as compared to a case in which the dividing structure is not adopted.

According to the seventh aspect embodiment of the invention, it is possible to make the structure less likely to be seen from a user.

According to the eighth aspect embodiment of the invention, it is possible to attach the base material on which the antenna is formed to the equipment more successfully, as compared to a case in which the present configuration is not adopted.

According to the ninth aspect embodiment of the invention, it is possible to avoid complication of a mold, as compared to a case in which there is no region that does not have any thread.

According to the tenth aspect embodiment of the invention, it is possible to eliminate displacement in the longitudinal direction in fitting.

According to the eleventh aspect embodiment of the invention, it is possible to fix the antenna structure more securely to equipment such as, for example, a thin ceiling board.

According to the twelfth aspect embodiment of the invention, when the antenna structure is attached to the equipment, it is possible to provide better visual appearance from the visible side of the equipment, as compared to a case in which the present technique is not adopted.

According to the thirteenth aspect embodiment of the invention, when the base material having plural antennas is attached to the equipment, it is possible to make the structure less likely to be seen from a user, as compared to a case in which the present technique is not adopted.

DESCRIPTION OF EMBODIMENTS

[Antenna Structure]

Hereinafter, an exemplary embodiment according to the present invention will be described in detail with reference to attached drawings.

First, by use of FIG. 1 to FIG. 5B, description will be given of an antenna structure to which the exemplary embodiment is applied.

Figure 1:
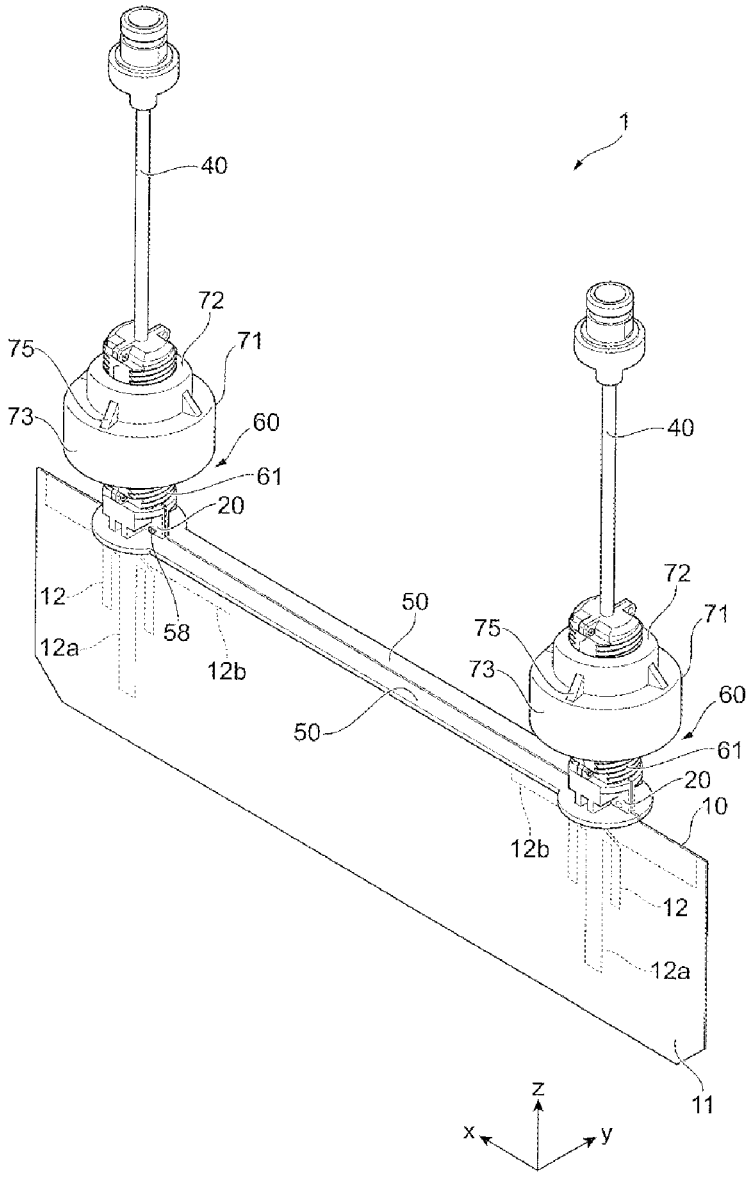
FIG. 1 is a perspective view showing a configuration of an antenna structure to which the exemplary embodiment is applied.
Figure 2:
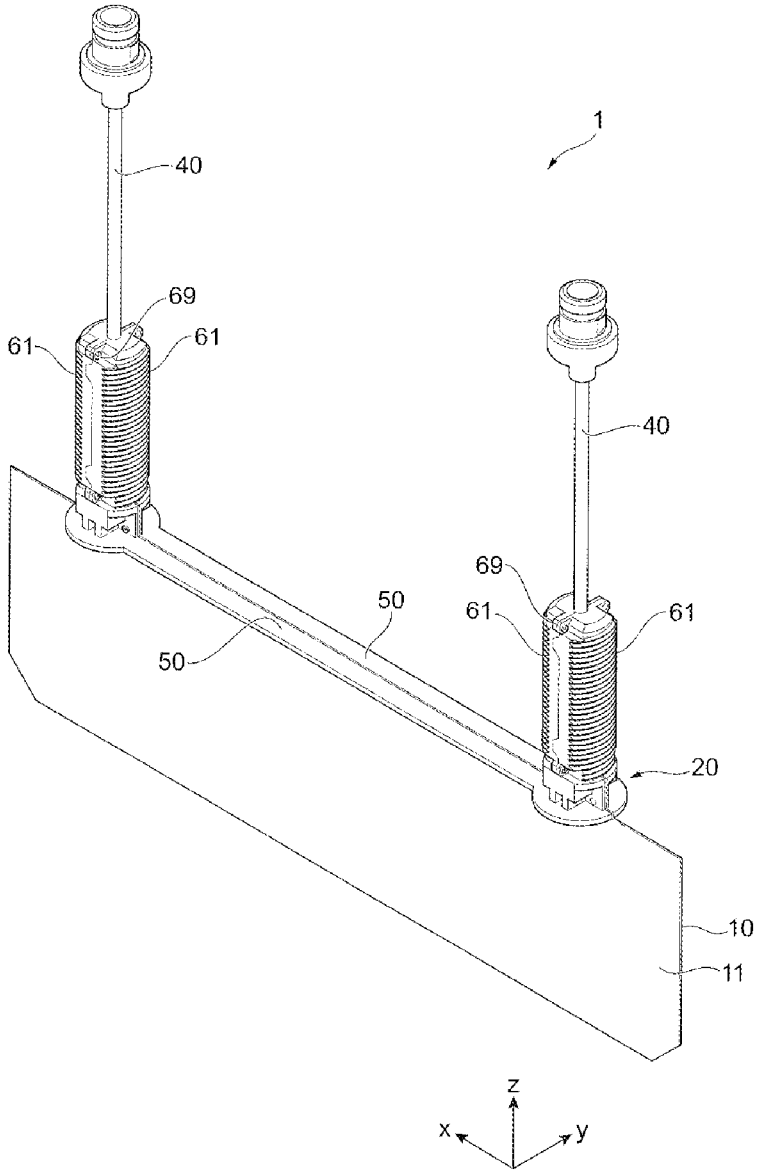
FIG. 2 is a perspective view showing a state in which nuts of positioning structures are detached from the antenna structure shown in FIG. 1.
Figure 3:
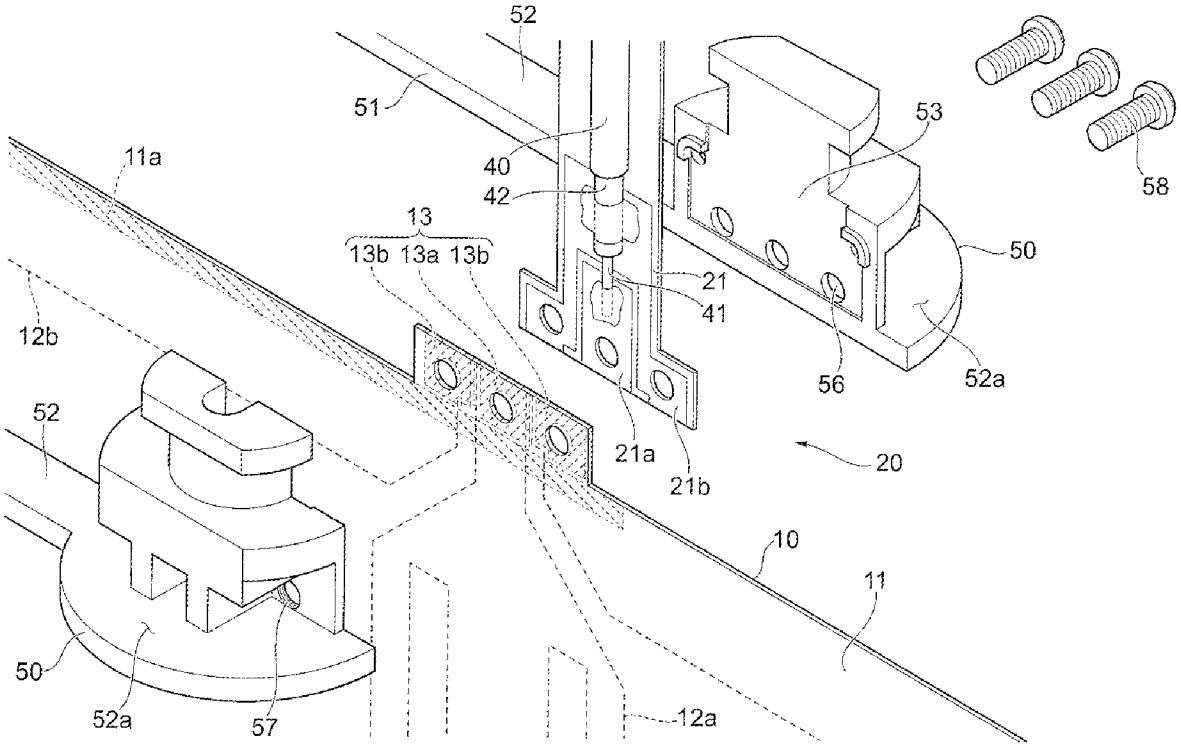
FIG. 3 is a diagram for illustrating a feeding part.
Figure 4A:
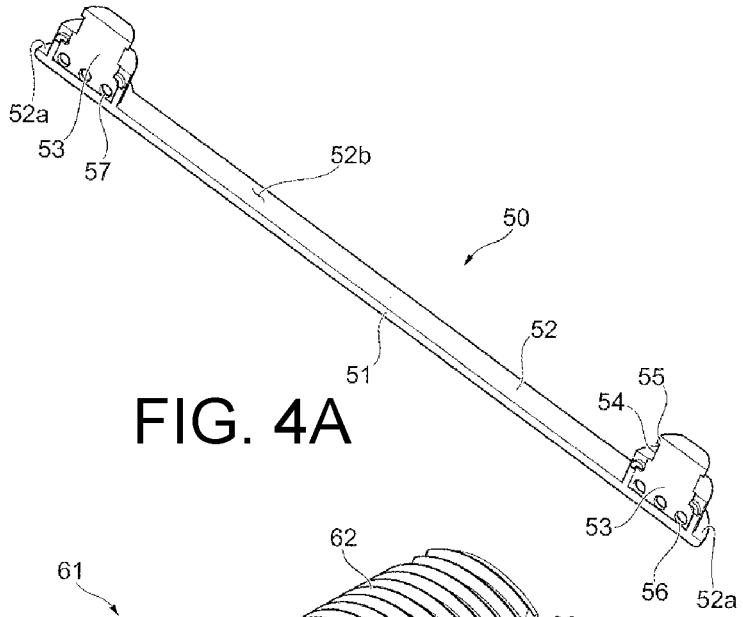
FIGS. 4A to 4C are configuration diagrams for illustrating a flange, a screw portion and the nut.
Figure 4B:
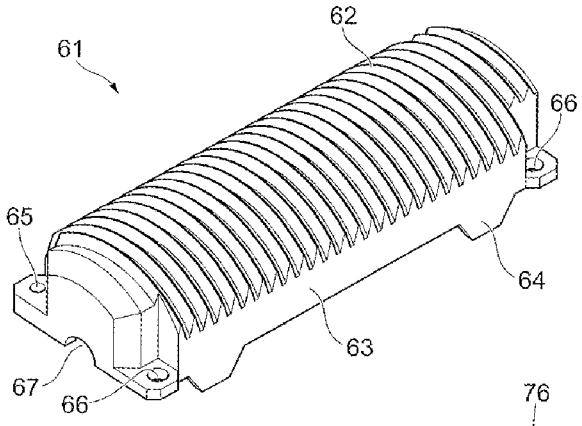
Figure 4C:
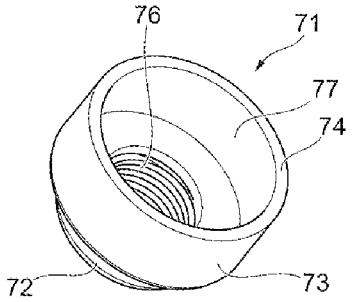
Figure 5A:
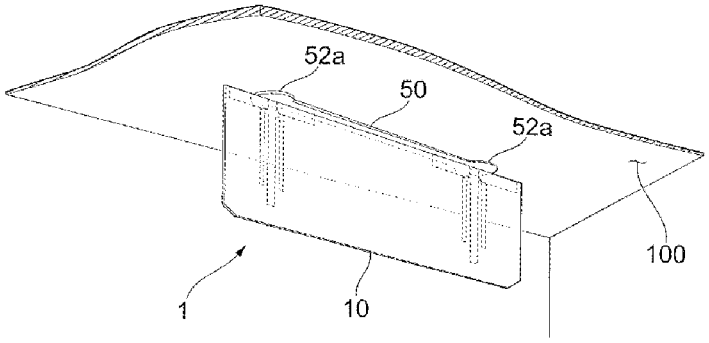
FIGS. 5A and 5B are diagrams for illustrating a state in which the antenna structure is attached to a ceiling, which is an example of the equipment.
Figure 5B:
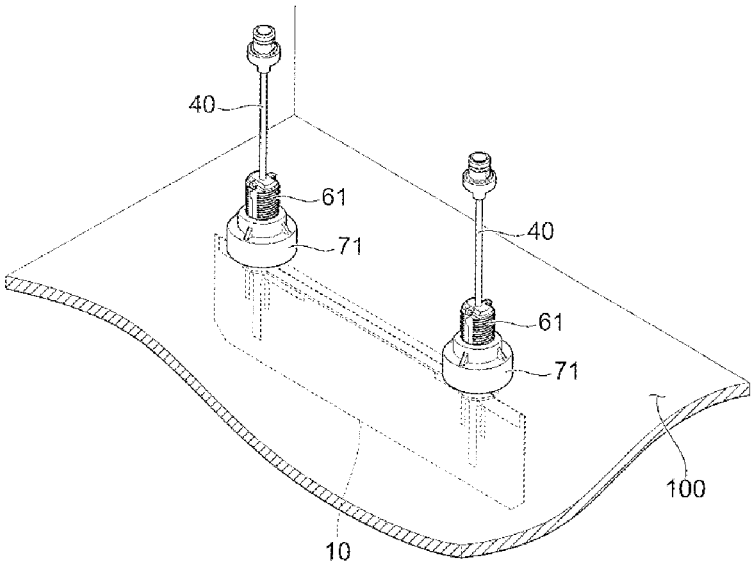

FIG. 1 is a perspective view showing a configuration of an antenna structure 1 to which the exemplary embodiment is applied. Moreover, FIG. 2 is a perspective view showing a state in which nuts 71 of positioning structures 60 are detached from the antenna structure 1 shown in FIG. 1. In addition, FIG. 3 is a diagram for illustrating a feeding part 20. Further, FIGS. 4A to 4C are configuration diagrams for illustrating a flange 50, a screw part 61 and the nut 71. Still further, FIGS. 5A and 5B are diagrams for illustrating a state in which the antenna structure 1 is attached to a ceiling 100, which is an example of the equipment.

Note that, in FIG. 1 and FIG. 2, the "x" direction is, for example, a drawing direction of a film 11 standing below a surface of the ceiling 100, which is an example of the equipment, the drawing direction extending along the surface of the ceiling 100, and the "y" direction extends along the surface of the ceiling 100 and is crossing to the "x" direction. Moreover, the "z" direction is crossing to the "x" direction and the "y" direction toward an invisible side of the ceiling 100 (upper side).

The antenna structure 1 to which the exemplary embodiment is applied includes: an antenna part 10 that is one of, for example, flexible printed circuit boards on which a high-frequency circuit is formed; and a feeding part 20 to which a coaxial cable 40 is connected, the coaxial cable 40 being one of feeding members for feeding power to the antenna part 10. Moreover, the antenna structure 1 includes the flange 50 and the positioning structures 60 for positioning the antenna part 10 and the feeding part 20 to the equipment, such as the ceiling 100.

[Antenna Part 10]

The antenna part 10 can be configured as a film antenna, and has the film 11 made of a transparent resin material having high light transmittance that transmits the visible light, such as, for example, PET (Polyethylene Terephthalate) resin, as a base material. Then, on the film 11, a conductive material is selected to increase the light transmittance and/or a conductive material is arranged to increase the light transmittance, and thereby the antenna 12 is formed. The antenna 12 includes a dual-frequency antenna 12*a* that uses two frequencies of, for example, the 800 MHz band and the 2.1 GHz band, and an antenna GND section 12*b* to be connected to the ground (GND).

In the example of the antenna structure 1 shown in FIG. 1, two sets of antennas 12 are provided to be compatible with a MIMO (multiple-input and multiple output) system that combines plural antennas 12 to increase throughput in data transmission and reception. Then, the feeding parts 20 are provided to correspond to the individual antennas 12, and in the example of the antenna structure 1 shown in FIG. 1, two sets of antennas 12 and feeding parts 20 are formed.

[Flange 50]

The flange 50 is a long structure assuming a direction in which the antenna part 10 connecting the two sets of antennas 12 extends (the "x" direction in the figure) as the longitudinal direction. The flange 50 includes a dividing structure to divide thereof in a direction crossing to a direction in which the film 11 of the antenna part 10 serving as a base material extends (the "y" direction in the figure), and has a function of positioning the film 11 from the visible side (for example, the lower side of the ceiling 100) of the equipment (for example, the ceiling 100). In the exemplary embodiment, the flange 50 is formed by a transparent resin member that transmits the visible light, in other words, that has light transmittance. To be suited to the color of the equipment, such as the ceiling 100, a colored visible light transmission member may be adopted, or, to be suited to the color or pattern of the equipment, a colored or patterned visible light non-transmission member may be adopted; however, to increase compatibility with others, it is more preferable to configure the flange 50 by a colorless visible light transmission member. In this manner, by configuring by the colorless visible light transmission member, it becomes unnecessary to select the member in conformity to a place of installation. Since this eliminates the needs for producing a large variety of members, mass production is better able to be realized.

Two (a pair of) flanges 50 position the antenna part 10 from the visible side of the equipment, such as the ceiling 100. In other words, the film 11 of the antenna part 10 is held by the pair of flanges 50 between the two sets of antennas 12, and the attitude of the film 11 between the two sets of antennas 12 is stably kept by the flanges 50. In this manner, the film 11 is held by the pair of flanges 50 and fixed, and accordingly, deformation or the like thereof is suppressed. Note that, in the exemplary embodiment, the thickness of the flange 50 (a facing surface 51 to be described later) is set to about 3 mm. If the thickness is too large, the transmittance is deteriorated, and the thickness is too small, it is impossible to stably fix the film 11. By properly setting the thickness, it is possible to stably fix the film 11 while maintaining the transmittance.

FIG. 4A shows a configuration of each flange 50. As the pair of flanges 50 to be attached to the equipment, to reduce the number of parts, those of the same shape are adopted.

As shown in FIG. 4A, the flange 50 includes a long part 52, and, on one and the other ends of the long part 52, assembly structures for the feeding parts 20 are formed, and also wide structures 52*a* having the width larger than those of the feeding parts 20 and the assembly structures are formed. In other words, the flange 50 includes plural wide structures 52*a* corresponding to the number of feeding parts 20, and includes the long part 52 as a coupling part that couples the plural wide structures 52*a*. The wide structure 52*a* has a function of holding the film 11 of the antenna part 10 to fix thereof. Each of the facing surfaces 51 facing each other when the two flanges 50 are fit together extends to locations where the wide structures 52*a* are formed; the film 11 of the antenna part 10 is in contact with the facing surfaces 51, and the film 11 is held by the two facing surfaces 51 of the two flanges 50. When the antenna structure 1 is attached to the equipment, such as the ceiling 100, an upper surface 52*b* of the long part 52 and the wide structures 52*a* are brought into contact with the equipment.

The assembly structures for the feeding parts 20 formed on one and the other ends of the long part 52 of the flange 50 are formed at the positions extending toward the invisible side (in the "z" direction) of the ceiling 100 (equipment), and each assembly structure includes the pressing surface 53 that presses the feeding part 20, a concave part 54 and a convex part 55, on the invisible side further than a pressing surface 53. Then, for pressing the feeding board (to be described later) by the pressing surface 53 by use of screws, screw fastening holes 56 are formed in the pressing surface 53 on one end, and threaded holes 57 are formed in the pressing surface 53 on the other end. The concave part 54 and the convex part 55 are fit into the screw part 61 at later assembly.

[Positioning Structure 60]

The positioning structure 60 includes the screw part 61 and the nut 71 as an example of a fastening part.

In the positioning structure 60, as shown in FIG. 2, in each of the two sets of feeding parts 20, a cylindrical male screw structure is formed, the male screw structure covering a circuit board (to be described later) extending from the feeding part 20 by the two screw parts 61. Then, the cylindrical male screw structure is provided to stand toward behind the ceiling, which is the invisible side of the equipment (the "z" direction). To reduce the number of parts, the two screw parts 61 to be used in combination have the same shape, and, for example, fixed by four vises 69 in each male screw structure. Moreover, since the two facing screw parts 61 have compatibility, it is possible to inverse the two screw parts 61 and combine thereof to form the male screw structure. The two screw parts 61 are inversed and integrated, and therefore, the fastening directions of the vises 69 are opposite directions in the right and the left (at the corresponding positions in the circumferential direction). Ordinarily, if the cylindrical male screw structure is formed by a single part, due to a relationship with a mold, it is required to take the part out of the mold while turning the part in the mold. However, by vertically dividing the cylindrical male screw structure, it is possible to reduce the effort required in molding.

Moreover, the screw part 61 in the exemplary embodiment is, different from the flange 50 formed of a light transmitting member, formed of an opaque member, such as an opaque resin that does not transmit the visible light. By use of the opaque member, light from the outside is blocked, and thereby, it becomes difficult to see the inside of the male screw structure formed by the two screw parts 61.

FIG. 4B shows a configuration of each screw part 61. As shown in FIG. 4B, the screw part 61 includes a screw threading part 62, planar parts 63 and fitting parts 64 extending from the planar parts 63. Moreover, threaded holes 65 and screw holes 66 for assembling and fixing the divided male screw structure are provided. Further, a cable guide groove 67 for passing the coaxial cable 40 and fixing thereof is included.

The screw threading part 62 includes a double-threaded screw structure. The double-threaded screw provides two rows of helical parts forming a screw thread, and moves forward twice as much as a pitch thereof during a turn. If a single-threaded screw structure is provided, when the male screw structure is divided into two, the pitches in the divided parts are displaced; therefore, even though the common divided parts are fitted, threads and cores of the screw parts do not match with each other, and accordingly, the common parts cannot be adopted as the divided parts. However, bilateral symmetry can be achieved by adopting the double-threaded screw structure, and, when the common screw parts 61 are fitted to adopt the male screw structure, one of the two screw threads can be continued; therefore, it is possible to realize a function as the male screw structure. Moreover, since the screw parts 61 can be produced by a single mold, generation of costs for the mold can be suppressed, and high productivity can also be achieved.

Moreover, in the exemplary embodiment, in the screw part 61, two planar parts 63 are formed, in which a part of the screw does not include the double-threaded screw structure. By providing a plane between the screw threading parts 62, the mold used in forming the screw parts 61 is simplified. In other words, if the screw threading part 62 is formed to the dividing portion, an end of the screw at the dividing portion is steep, and thereby, a drawing mold becomes complicated. Therefore, by providing the planar part 63, complication of the mold is avoided. Moreover, a nameplate of the product can be attached to the planar part 63. Moreover, in the screw part 61, the fitting part 64 is provided at a position continued to the planar part 63. The convex shape is shown in FIG. 4B; however, as shown in FIG. 2, the counterpart to be fitted over the convex shape has the concave shape. This makes it possible to eliminate displacement in the longitudinal direction in fitting, and to smoothly fasten by the nut 71. Note that the planar part 63 is not necessarily be a flat surface, and may be, for example, a curved surface.

The nut 71 in the positioning structure 60 is screwed over the male screw structure formed by the two screw parts 61 from the invisible side, and is fastened to fix the antenna structure 1 from the backside (invisible side) of the ceiling 100. The nut 71 to which the exemplary embodiment is applied includes, as shown in FIG. 1 and FIG. 4C, a small outer diameter part 72 having a female screw inside thereof, a large outer diameter part 73 having a pouch-shaped interior 77, and an annular-shaped bottom surface 74 formed at the end portion of the large outer diameter part 73. Between the small outer diameter part 72 and the large outer diameter part 73, ribs 75 are provided. To fasten the nut 71, a user has his/her fingers on the ribs 75, fastening is easily carried out.

The nut 71 in the exemplary embodiment is, different from the flange 50 formed of a light transmitting member, formed of an opaque member, such as an opaque resin that hardly transmits the visible light. Similar to the screw part 61, by use of the opaque member, transmittance of light from the outside (for example, from the backside of the ceiling 100) is suppressed (or blocked), and thereby, it becomes difficult to see the structures contained in the interior 77 from the antenna part 10 side (for example, from the front side of the ceiling 100).

Here, in the ordinary structure of screw and nut, fastening can be carried out only in the threaded portion. However, in the nut 71 in the exemplary embodiment, since the interior 77 is in the pouched shape, fastening can be carried out until the bottom surface 74 of the nut 71 is pressed against the back surface of the equipment, such as the ceiling 100; therefore, fixing is securely performed to a thin ceiling board or the like. At this time, the feeding part 20 is covered with the pouch-shaped interior 77. Since the interior 77 of the nut 71 covering the feeding part 20 is in the pouched shape, for example, light from the invisible side, which is the backside of the ceiling 100, hardly exits toward the visible side of the ceiling 100. In general, to see from the light side to the dark side, it becomes difficult to see the dark side by reflection. Though there is a feeding portion, which is a structure, in the interior 77 of the nut 71, since the interior 77 of the nut 71 is made into the pouched shape and a space portion hardly transmits (or blocks) light, it is difficult to see the feeding portion from the antenna part 10 side (for example, from the front side of the ceiling 100), and a feeling of a foreign body is not provided to a user.

[Feeding Part 20]

Next, the feeding part 20 to which the exemplary embodiment is applied will be described. In the exemplary embodiment, there are provided plural feeding parts 20 to which the coaxial cables 40 serving as the feeding members for feeding power to the individual antennas 12, the coaxial cable 40 extending from the individual antenna 12 of the plural antennas 12.

As shown in FIG. 3, the individual feeding part 20 includes a feeding board 21 to which the coaxial cable 40 is connected, and a contact point 13 of the antenna part 10 is pressed against the feeding board 21 by the pressing surface 53 of the flange 50. The feeding board 21 include patterns formed of, for example, copper on a surface facing the contact point 13 of the antenna part 10, which is on a circuit board of a glass-epoxy material, such as FR-4 (Flame Retardant-4) or CEM-3 (Composite epoxy material-3). In the feeding board 21, a feeding board antenna feeding section 21*a* at the center, and a feeding board GND section 21*b* around the feeding board antenna feeding section 21*a*, which is insulated from the feeding board antenna feeding section 21*a*, are formed. Then, the feeding board antenna feeding section 21*a* provided at the center of the feeding board 21 and a core wire 41 of the coaxial cable 40 are joined by solder, and the feeding board GND section 21*b* on the feeding board 21 and an outer conductor 42 of the coaxial cable 40 are joined by solder.

In the assembly of the feeding part 20, the feeding board antenna feeding section 21*a* of the feeding board 21, to which the coaxial cable 40 is soldered, and the feeding board GND sections 21*b* are caused to face the contact point 13 of the antenna part 10, and are pressed against the contact point 13 by two flanges 50. Then, screws 58 are inserted into the screw fastening holes 56 of one of the flanges 50, and screwed into the threaded holes 57 of the other flange 50; accordingly, the feeding board 21 and the antenna part 10 are held by the two flanges 50. At this time, in the antenna part 10, not only the contact point 13, but also an upper end region 11*a* of the film 11 is held between the two flanges 50, and thereby the attitude of the film 11 serving as the base material of the antenna part 10 is preferably maintained. Note that, on one end side and the other end side of the long part 52 in which the two flanges are fitted, the directions of inserting the screws 58 are opposite.

Moreover, by providing a structure in which the feeding board 21 is pressed by the two flanges 50, the feeding board 21 and the contact point 10 of the antenna part 10 are pressed without requiring a pressing member separately, to be securely connected. Then, by disposing the feeding board 21 that cannot be transparent at the backside of the ceiling 100, which is the invisible side, it is possible to obscure the feeding board 21 from the front side of the ceiling 100, which is the visible side, to thereby make visual appearance from the visible side better.

[Assembly of Positioning Structure 60]

As described by use of the aforementioned FIG. 3, the feeding parts 20 are assembled by the flanges 50, and thereafter, by using the screw parts 61 shown in FIG. 4B, the structure as shown in FIG. 2 is assembled. More specifically, in the direction (the "x" direction) crossing to the direction in which the two flanges 50 are fitted to hold the film 11 (the "y" direction), one of the screw parts 61 and the other screw part 61 vertically inversed in the "z" direction are pressed against each other. Though not shown in the figure, inside the screw part 61, cuts are formed in accordance with the concave part 54 and the convex part 55 of the flange 50. Then, the convex shape of the fitting part 64 of one of the screw parts 61 and the concave shape of the fitting part 64 of the other screw part 61 are engaged, and assembled as shown in FIG. 2. By the cuts inside the screw part 61, the concave part 54 and the convex part 55 of the flange 50, the positions of the flange 50 and the screw part 61 are uniquely determined, and combined. At this time, the coaxial cable 40 is guided by the cable guide groove 67 shown in FIG. 4B. Thereafter, four vises 69 for one feeding part 20 are inserted while changing directions in the "y" direction and fastened, and thereby the screw parts 61 of the positioning structures 60 and the flanges 50 including the antenna parts 10, the feeding parts 20 and the coaxial cables 40 are formed as one structure as shown in FIG. 2.

[Example of Installation to Ceiling 100]

FIG. 5A is a diagram viewing, from the visible side, which is the lower side of the ceiling 100 (a living space), the antenna structure 1 installed to the ceiling 100. On the other hand, FIG. 5B is a diagram viewing, from the invisible side, which is the upper side of the ceiling 100 (behind the ceiling), the antenna structure 1 installed to the ceiling 100. In the ceiling, through holes are formed, each of which has a dimensional range capable of passing the projection part (the pressing surface 53, the concave part 54 and the convex part 55) of the flange 50 constituting the feeding part 20 and incapable of passing the wide structure 52*a* of the flange 50.

As shown in FIG. 5A, on the visible side of the ceiling 100, only the antenna part 10 and the flanges 50 (the long parts 52 and the wide structures 52*a* of the flanges 50) constituting the antenna structure 1 appear, and the other structures do not appear on the surface. As the film 11 serving as the base material of the antenna part 10, the transparent material having high light transmittance is used, and the antenna 12 is formed to have high light transmittance; therefore, the antenna part 10 has high light transmittance as a whole. Further, in addition, the flange 50 appearing on the visible side is formed by a transparent resin member that transmits the visible light, in other words, that has light transmittance. In this manner, all the structures in the exposed part that can be seen from a user are transparent, and it is possible to cause the antenna structure 1 to blend in with the environment.

On the other hand, as shown in FIG. FIG. 5B, on the upper side of the ceiling 100 (behind the ceiling), the nuts 71 are screwed over the screw parts 61, and the bottom surfaces 74 (refer to FIG. 4C) of the nuts 71 are pressed against the back surface of the ceiling 100 and fastened. Consequently, the long parts 52 and wide structures 52*a* of the flange 50 are brought into contact with the ceiling 100 from the visible side of the ceiling 100, the bottom surfaces 74 of the nuts 71 are pressed from the invisible side of the ceiling 100, and thereby the antenna part 10 is fixed to the ceiling 100. Note that, since the nut 71 is a member of non-transmittance as described above and the interior 77 of the nut 71 is in the pouched shape, the interior 77 becomes a dark space, and thereby, it is difficult to see the structures from the visible side.

MODIFIED EXAMPLES

Figure 6A:
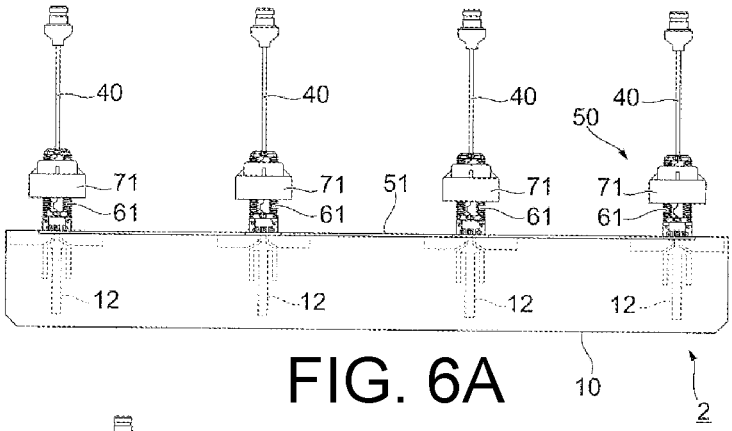
FIGS. 6A to 6C are diagrams showing modified examples of the antenna structure 1, which is the aforementioned exemplary embodiment.
Figure 6B:
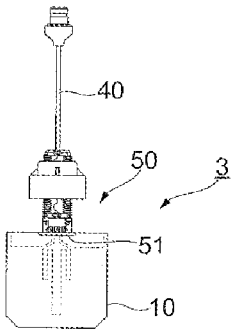
Figure 6C:
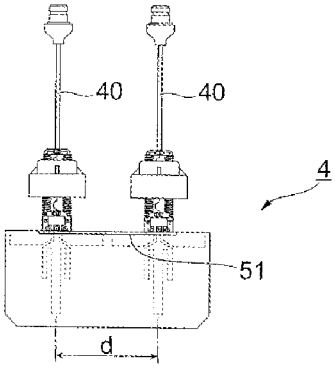

FIGS. 6A to 6C are diagrams showing modified examples of the antenna structure 1, which is the aforementioned exemplary embodiment. An antenna structure 2 shown in FIG. 6A is provided with four antennas 12 in the antenna part 10, four screw parts 61 of the positioning structures 60 and four nuts 71. In the flange 50, as a modification of FIG. 4A, four wide structures 52*a* are formed in one long part 52. In this manner, in the exemplary embodiment, the number of antennas 12 is not only two, but also plural antennas 12, such as four, six, or the like, can be formed in one structure. Even in the case where the antenna structure 2 is configured like this, by using the visible light transmission member for the flange 50 to cause those seen from the visible side of the ceiling 100 to transmit the visible light, when the antenna structure 2 is attached to the ceiling 100, it is possible to cause the antenna structure 2 to blend in with the environment. Moreover, even in the case where the number of antennas is increased to four, six, or the like, the film 11 of the antenna part 10 is sandwiched by the facing surfaces 51 of the flanges 50, and therefore, the film 11 can be held in the extended state.

In an antenna structure 3 shown in FIG. 6B, the number of antennas 12 formed in the single structure is one. In this manner, in the exemplary embodiment, the number of antennas 12 is not plural; a single antenna 12 and a positioning structure 60 with a single screw part 61 and a single nut 71 are used. Even in such a case, by using the visible light transmission member for the flange 50, even when the antenna structure 3 is attached to the ceiling 100, it is possible to reduce a feeling of strangeness potentially caused to a user with installation of the structure.

An antenna structure 4 shown in FIG. 6C is characterized in that a distance d formed by two adjacent antennas 12, from among the plural antennas 12, is shorter than that of the antenna structure 1 shown in FIG. 1. For example, the pitch between the centers of the antennas 12 is about 200 mm in the antenna structure 1, but, in the antenna structure 4, the pitch (the distance d) between the centers of the antennas 12 is as short as about 70 mm. Here, for the flange 50, the visible light transmission member is also adopted, and visibility from the visible side of the ceiling 100 is lowered, to thereby reduce the feeling of strangeness in the environment.

Note that, in the exemplary embodiment, description has been given of the cases in which the antenna structures 1 to 4 are attached to the ceiling 100 as an example of the equipment; however, it is possible to attach the structures to other equipment, such as a vertical wall. In such a case, the side which the antenna faces serves as the visible side, and a side opposite to the visible side serves as the invisible side.

The invention claimed is:

1. An antenna structure, comprising:

a base material on which an antenna is formed, the base material transmitting visible light;

a feeding part to which a feeding member for feeding power to the antenna is connected;

a flange that positions the base material from a visible side of an equipment, and transmits visible light; and a positioning structure for performing positioning from an invisible side of the equipment, to which an operation of attaching the base material is performed.

2. The antenna structure according to claim 1, wherein when the base material is attached to the equipment, the feeding part is provided at a position facing toward the invisible side of the equipment with respect to the base material.

3. The antenna structure according to claim 2, wherein the feeding part is formed integrally with the flange at a position opposite to an attachment side of the base material from the flange.

4. The antenna structure according to claim 1, wherein the flange includes a wide structure having a width wider than that of the feeding part, and holds the base material to fix thereof.

5. The antenna structure according to claim 4, wherein the flange includes a plurality of the wide structures corresponding to the number of the feeding parts, and also includes a coupling part that couples the plurality of the wide structures.

6. The antenna structure according to claim 1, wherein the flange has a dividing structure divided into a direction crossing to a direction in which the base material extends, and the positioning structure includes:

a screw part that is divided into a direction crossing to a dividing direction of the dividing structure of the flange; and a fastening part that is screwed over the screw part to fasten the flange to the equipment.

7. The antenna structure according to claim 1, wherein the positioning structure is formed by a member that transmits less visible light than the flange.

8. The antenna structure according to claim 1, wherein the positioning structure comprises:

a screw part that is assembled to the feeding part and covers a circuit board extending from the feeding part; and a fastening part that positions the base material to the equipment by fastening the screw part by screwing from the invisible side of the equipment.

9. The antenna structure according to claim 8, wherein the screw part of the positioning structure includes a region with no thread.

10. The antenna structure according to claim 9, wherein the positioning structure is divided into plural in the region, and each dividing surface includes a concave part and a convex part, the concave part and the concave part being fitted together when the positioning structure is assembled to the feeding part.

11. The antenna structure according to claim 1, wherein the antenna structure is fixed to the equipment by a nut, comprising:

a female screw, having a first diameter; and a pouch-shaped part, having a second diameter larger than the first diameter.

12. An antenna structure, comprising:

a base material on which a plurality of antennas is formed, the base material being formed by a film material or a plate material transmitting visible light;

a plurality of feeding parts, to each of which a feeding member extending from each of the plurality of antennas for feeding power to each of the antennas is connected; and a flange that transmits visible light, the flange holding the base material and coupling the plurality of feeding parts, wherein the base material and the flange transmitting the visible light are exposed portions that are seen from a user, and the plurality of feeding parts is not included in the exposed portions.

13. The antenna structure according to claim 12, further comprising:

a positioning structure provided for each of the plurality of feeding parts and positioning the base material to an equipment, wherein the positioning structure is formed by a member that transmits less visible light than the flange.

* * * * *